United States Patent [19]

Diemer

[11] Patent Number: 5,029,625

[45] Date of Patent: Jul. 9, 1991

[54] MACHINE FOR REDUCING THE SIZE OF MATERIAL

[75] Inventor: Bodo Diemer, Albstadt, Fed. Rep. of Germany

[73] Assignee: Diemer-Automat GmbH, Albstadt, Fed. Rep. of Germany

[21] Appl. No.: 515,500

[22] Filed: Apr. 27, 1990

[30] Foreign Application Priority Data

Apr. 28, 1989 [DE] Fed. Rep. of Germany ..... 3914086

[51] Int. Cl.[5] ..... B27C 1/00

[52] U.S. Cl. ..... 144/162 R; 144/193 R; 144/366; 144/369; 144/180

[58] Field of Search ..... 144/3 K, 162 R, 193 R, 144/193 D, 193 F, 366, 369, 180

[56] References Cited

U.S. PATENT DOCUMENTS

| | | | |
|---|---|---|---|
| 2,760,533 | 8/1956 | Bass | 144/162 R |
| 4,086,111 | 4/1978 | Corey | 144/193 A |
| 4,337,809 | 7/1982 | Bertolette et al. | 144/3 K |
| 4,340,098 | 7/1982 | Scott | 144/193 A |
| 4,751,949 | 6/1988 | Berner | 144/193 A |
| 4,945,960 | 8/1990 | McCauley | 144/193 A |

*Primary Examiner*—W. Donald Bray

*Attorney, Agent, or Firm*—Robert W. Becker & Associates

[57] ABSTRACT

A machine for reducing the size of material is provided. A movable blade is moved at least nearly parallel to a fixed blade via a raising and lowering mechanism, and is supplied with a force that opposes a cutting pressure. Only a single drive is necessary for the movable blade, so that the machine has a structurally simple and economical configuration. Since the blades are moved parallel to one another at low speed, the noise and dust emission is extremely low. The cutting pressure necessary for the cutting process is applied by the raising and lowering mechanism. The force required is kept small since the material is cut in a shearing process.

30 Claims, 5 Drawing Sheets

MACHINE FOR REDUCING THE SIZE OF MATERIAL

BACKGROUND OF THE INVENTION

The present invention relates to a machine for reducing the size of material, such as wood, wood-like material, etc., especially residual wood, plastic, etc., and includes a container for the material, as well as at least one fixed and at least one movable blade. To remove residual pieces of wood and scrap in woodworking and wood processing industry operations, in addition to the profile cutting or chipping, to reduce the size of the residual pieces of wood into chip form, four machine constructions that differ in their technique and end product are utilized. Involved are drum chippers, disk chippers, pulverizing machines, and crushing mills.

Drum chippers have a rotor that is equipped with a plurality of chipping blades that are disposed in the surface line; the chipping process is effected via a further fixed counterblade. The end product is a course chopped pulp having fiber lengths between 20 and 100 mm. The thus generated pulp is mainly used in the paper, cellulose, and panel industries.

With disk chippers, various blades are diametrically disposed on a rotating disk. During the chipping process, these blades similarly operate against a counterblade, thereby generating a chopped pulp that due to a more chipping than chopping process produces a considerably better quality than is possible with drum chippers. The chopped pulp from the disk chippers is therefore mainly used for producing paper and cellulose via a chemical solution.

Pulverizing machines, so-called slow-moving rotors, have a slowly rotating, horizontally disposed rotor cylinder that is provided with toothed shearing blades that are helically disposed about the axis, and a hydraulically or mechanically driven box feed. In this connection, the residual wood is pressed by the box feed against the toothed shearing cylinder, that by means of its shearing teeth reduces the size of the wood that rests against the cylinder. Depending upon the size of the shearing teeth, the end product is randomly shaped, course chips and fragments that are mainly suitable for being burned in automated or mechanized combustion units.

Crushing mills have a vertically disposed, slowly rotating rotor that is similarly equipped with blades. The material is thrown into a hopper, at the lowest point of which the rotor is disposed. The residual pieces of wood are fed to the blades via gripper arms that are helically disposed on the rotor. Depending upon how the blades are provided, the product is anywhere between fine to course chips or crumbs that are similarly used mainly for being burned in automated or mechanized combustion units.

The first mentioned chippers are primarily used in woodworking operations, especially in sawmills. These chippers are relatively easy to integrate into completely mechanized units. Their construction is sturdy and mature, and its product corresponds to the market requirements.

The further mentioned pulverizing machines and crushing mills are utilized nearly exclusively in woodworking operations, namely furniture factories, cabinet making shops, molding factories, etc., in other words, everywhere that multiform residual pieces of wood that result from the operation must be reduced in size. Such machines can be installed in mechanized units to only a limited extent, since their constructions are relatively susceptible to breakdown. The product conforms to the requirements set for combustible material.

All of the aforementioned groups of machines have more or less the same drawbacks. For example, they emit an extraordinarily great amount of noise, especially the chippers, the dampening of which, to the extent that this is even possible, as required by today's work protection regulations, involves high capital investments and drawbacks for operation. Furthermore, these machines have high dust emissions (macro values) with a rotating tool and high blade speeds, and hence a high level of dust production and dust turbulence. A further drawback is an extremely high force requirement for the size-reduction process with a rotating shaft and connected load values that, depending upon the size and design of the machine, are between approximately 30 and 200 KW. In addition the service lives of the instruments are relatively short due to the high blade speed and impact stress when material that is to be cut is not wedged. Furthermore, high investment costs result with these known machines due to inherently expensive constructions having multiple drive units.

The named drawbacks of the residual wood pulverizing machines having a rotating tool, to which class the aforementioned machines belong, involve of technical and also economical problems, especially when used in small plants. Chippers and conventional slow-moving rotors, as well as mills, can be installed with only great difficulty in small and medium size plants, especially in handicraft operations. The investment costs for these units exceed the investment capability of such operations. On the other hand, it is just these operations that urgently require an optimally mechanized and automated machine via which residual pieces of wood that are produced during production can be converted into chips that are required as combustion material by the operation to generate heat or steam.

It is an object of the present invention to provide a size-reducing machine that is technically and economically suitable for use in small and medium size operations in the woodworking and wood processing industries.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

The size-reducing machine of the present invention is characterized primarily by a raising and lowering mechanism for moving the movable blade east nearly parallel to the fixed blade and for supplying to the movable blade a counteractive force that opposes the cutting pressure.

As a consequence of the inventive construction, the size-reducing machine can be bodied in such a way that it is structurally very straightforward and economical, since a drive means is required only for one of the blades. Due to the fact that the blades are movable parallel to one another at a low speed, the noise and dust emission is extremely low. The cutting pressure required for the cutting process can be effortlessly applied by the raising and lowering mechanism. Since the material can be cut in a shearing process, the force that is required can be kept low in a simple manner. In addition, the service lives of the instruments can be increased, so that the inventive machine is also advantageously suitable for small and medium size operations. Plastic parts, such as profile scraps in the plastic industry, can also be excellently reduced in size with the inventive machine.

Due to the parallel guidance of the movable blade relative to the fixed blade, it is possible to reduce the size of the wood scrap in a shearing process with no difficulty.

Further specific features of the present invention will be described in detail subsequently.

DESCRIPTION OF PREFERRED EMBODIMENTS

Figure 1:
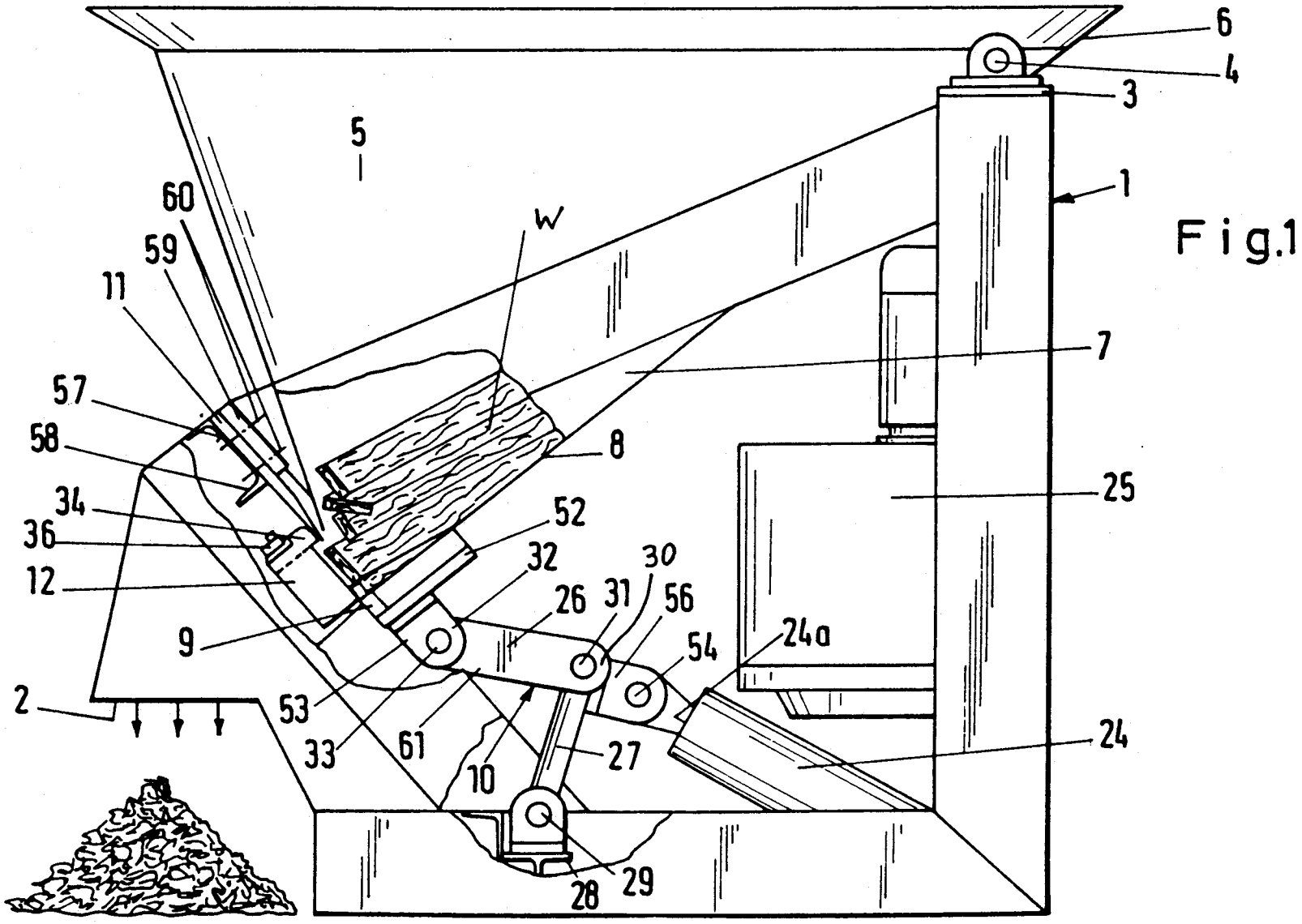
FIG. 1 is a partially broken-away side view of one exemplary embodiment of the inventive size-reducing machine for wood, wood-like material, etc.

Referring now to the drawings in detail, the size reduction machine illustrated in FIG. 1 is provided with a frame structure 1 and a chip discharge 2. Disposed at the upper end 3 of the frame structure 1 is a pivot shaft 4 for a funnel-like feed hopper 5 for wood W that is to be chipped or otherwise reduced in size. The pivot shaft 4 extends horizontally and is provided in the vicinity of the upper corner region 6 of the hopper 5. The hopper has a lower discharge portion 7 in which is disposed a transversely extending bottom or counterblade 9 in the base 8 of the hopper. The hopper 5 is disposed at an angle in the space provided therefor, and is pivoted about the shaft 4 in a vertical direction via a raising and lowering mechanism 10 that will be described in detail subsequently.

Associated with the counterblade 9 is a top or shearing blade 11 that is fixedly disposed on the machine frame 1. When the hopper 5 is pivoted upwardly, the counterblade 9 is moved in a parallel manner against the shearing blade 11, as a result of which the blades form a self-closing shearing pincers via which the material that is in the hopper is cut or sheared off.

Feeding of the wood W that is present in the hopper 5 is accomplished by the effect of the force of gravity. For this purpose, the base 8 of the hopper is inclined, for example, at an angle of approximately 40° relative to the horizontal. As a result, the free material in the hopper 5 automatically slides downwardly in the direction toward the abutment means 12 and hence onto the counterblade 9. An abutment means 12 that extends perpendicular to the base 8 of the hopper and in mid-position is disposed ahead of the lower discharge portion 7 delimits the forward sliding of the material when the hopper 5 is pivoted downwardly. The abutment means 12, which is securely yet detachably connected to the machine, also determines the length of cut as a consequence of how far it is spaced from the cutting edge of the top blade 11. The upper side of the counterblade 9 is flush with the base 8 of the hopper, so that the material W can slide down to the abutment means 12 in an unobstructed manner.

Figure 4:
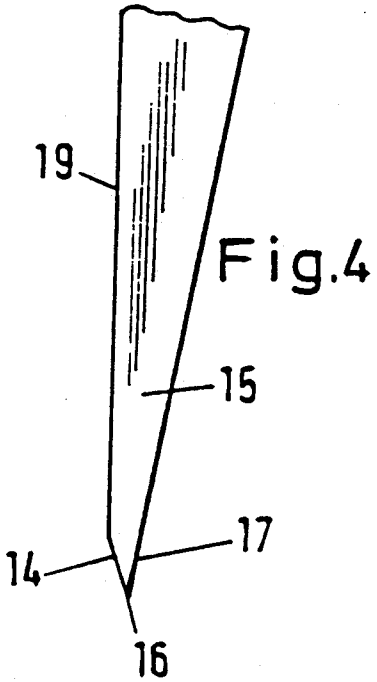
FIG. 4 is an enlarged view of the lower portion of the blade of FIG. 3.
Figure 3:
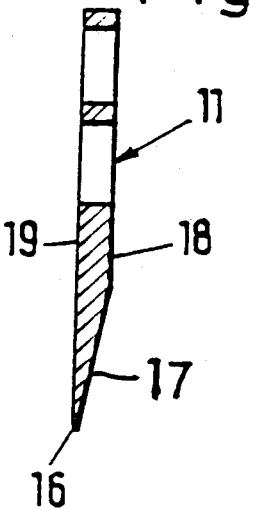
FIG. 3 is a cross-sectional view taken along the line III—III in FIG. 2.
Figure 2:
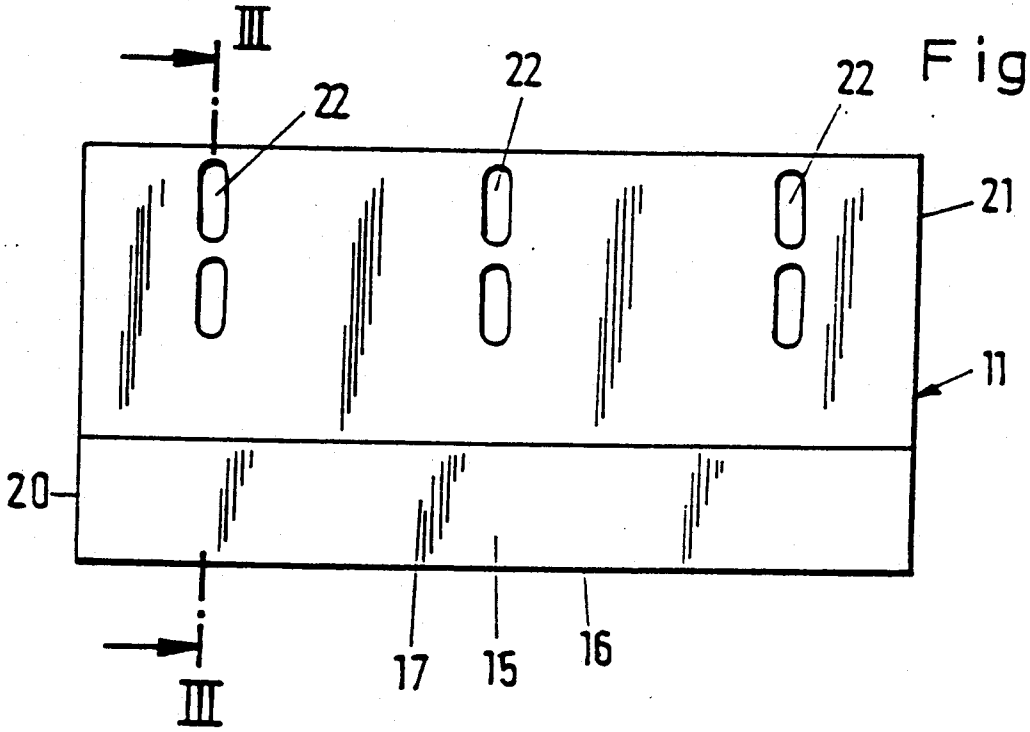
FIG. 2 is an enlarged view of an upper blade of the machine of FIG. 1.

As shown in FIGS. 2 to 4, the shearing blade 11 has a rectangular contour and is provided with a cutting edge 16 on the long side 15. A flat back side 19 of the shearing blade 11 rests against a support surface 57 that is preferably provided on a beam 58 of the machine frame 1 (see FIG. 1). the back side 19 is provided with chamfer 14 at the cutting end. The shearing blade 11 is secured to the rail or beam 58 by means of a clamping strip 59 (FIG. 1). This clamping strip 59 rests upon a flat front side 18 of the shearing blade 11 (see FIG. 3); the front side 18 extends parallel to the back side 19 and has a chamfer 17 that extends to the cutting edge 16. The chamfer 17 is longer than the chamfer 14 and extends over approximately one third of the height of the shearing blade 11.

Figure 6:
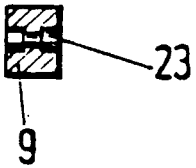
FIG. 6 is a cross-sectional view taken along the line VI—VI in FIG. 5.
Figure 5:
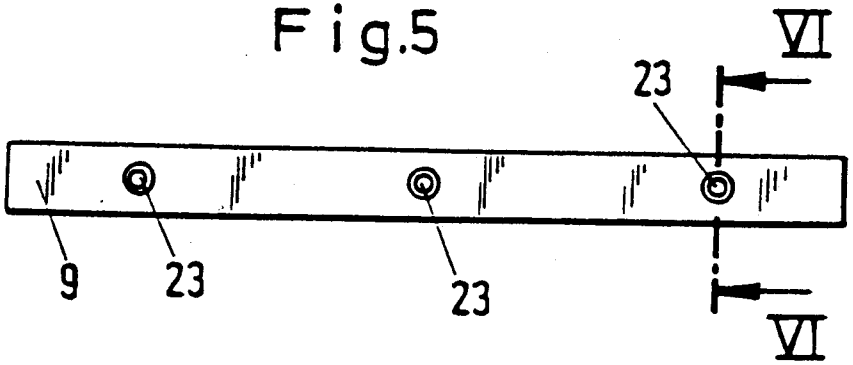
FIG. 5 is an enlarged view of a lower blade of the machine of FIG. 1.

Above the long side 15, the shearing blade 11 is provided with spaced-apart elongated slots 22 that are also spaced from the narrow sides 20 and 21. The slots 22 are disposed in pairs whereby when viewed in the direction of the height of the blade 22 the slots of each pair are disposed one above the other. As shown in FIG. 1, threaded bolts 60 pass through the elongated slots 22 for securing the clamping strip 29 to the beam 58: the shearing blade 11 is sandwiched between the clamping strip 59 and the beam 58. By means of the elongated slots 22, the shearing blade 11 can be aligned very precisely relative to the frame structure 1 and the counterblade 9. The slots 22, which extend in the direction of height of the shearing blade 11, permit an infinite and precise adjustment of the shearing blade. Even after the shearing blade 11 has been reground, it is possible in the manner described to obtain a simple yet precise orientation relative to the counterblade 9. As shown in FIGS. 5 and 6, the counterblade 9 is in the form of a bar. Holes 23 are distributed over the length of the counterblade and serve to receive screws or the like for the securement of the counterblade.

The raising and lowering mechanism 10 is preferably controlled via a hydraulic cylinder 24 that is connected to a hydraulic system 25 provided in the frame structure 1, with the hydraulic cylinder 24 being pivotably mounted on the frame structure. The mechanism 10 is an elbow joint arrangement that essentially comprises an upper elbow lever 26 and a lower elbow lever 27. In place of the hydraulic raising and lowering mechanism, a mechanically operating raising and lowering mechanism could also be provided.

The lower elbow lever 27 is embodied as a swivel arm, and with regard to its configuration and thickness of the material is absolutely torsionally rigid and broad. The lower elbow lever 27, which is thus embodied as a relatively thick plate, is pivotably mounted at its lower end, on both sides, on respective shafts 29 that are provided on a base plate 28. In order to achieve a torsion-free design, the upper elbow lever 26 advantageously has a box-type construction. For this purpose, the upper elbow lever 26 is formed by two side pieces 61 that are interconnected by a (non-illustrated) cross member that is preferably embodied as a hollow section. Provided on both sides of the lower end 30 of the upper elbow lever 26 is a respective elbow joint pivot means 31 that is also supported on the lower elbow lever 27. Both sides of the upper end 32 of the elbow lever 26 are mounted on a respective shaft 33 that is transversely disposed below the hopper 5. The shafts 33 are disposed in brackets 53 that extend parallel to one another and project perpendicularly downwardly beyond a support 52. The hydraulic cylinder 24 is similarly pivotably linked to the lower elbow lever 27 via a shaft 54. The shaft 54 is mounted in brackets 56 that extend from the elbow lever 27. The three shafts 29, 31, 33 are disposed parallel to one another and are exactly aligned relative to the base 8 of the hopper and the support 52 for the counterblade 9 in the hopper 5. As a result, when the elbow joint arrangement 10 is actuated, an absolutely parallel, transversely rigid and shift-free raising an lowering of the hopper 5 with the counterblade 9 is assured about the shaft 4 of the hopper in the region of the circular sector defined by the stroke of the elbow levers.

To orient the shearing blade 11 relative to the counterblade 9, the hopper 5 is first pivoted into its uppermost position via the elbow lever 10. In this position, the cutting edge 16 of the shearing blade 11 is then placed loosely upon the counterblade 9. The threaded bolts 60, or other securing means, are then tightened, whereupon the shearing blade 11 is securely held against the support surface 57 via the clamping strip 59. The hopper 5 is subsequently again pivoted downwardly via the elbow lever 10, as a result of which the wood W that is to be cut slides down. By subsequently raising the hopper 5, a uniform shearing cross-section is achieved over the entire blade width, with the shearing blade 11 being placed precisely parallel upon the counterblade 9. It should be noted that tho shearing blade 11 can also be adjusted in such a way that the cutting edge 16 thereof is spaced slightly from the counterblade 9.

Figure 11:
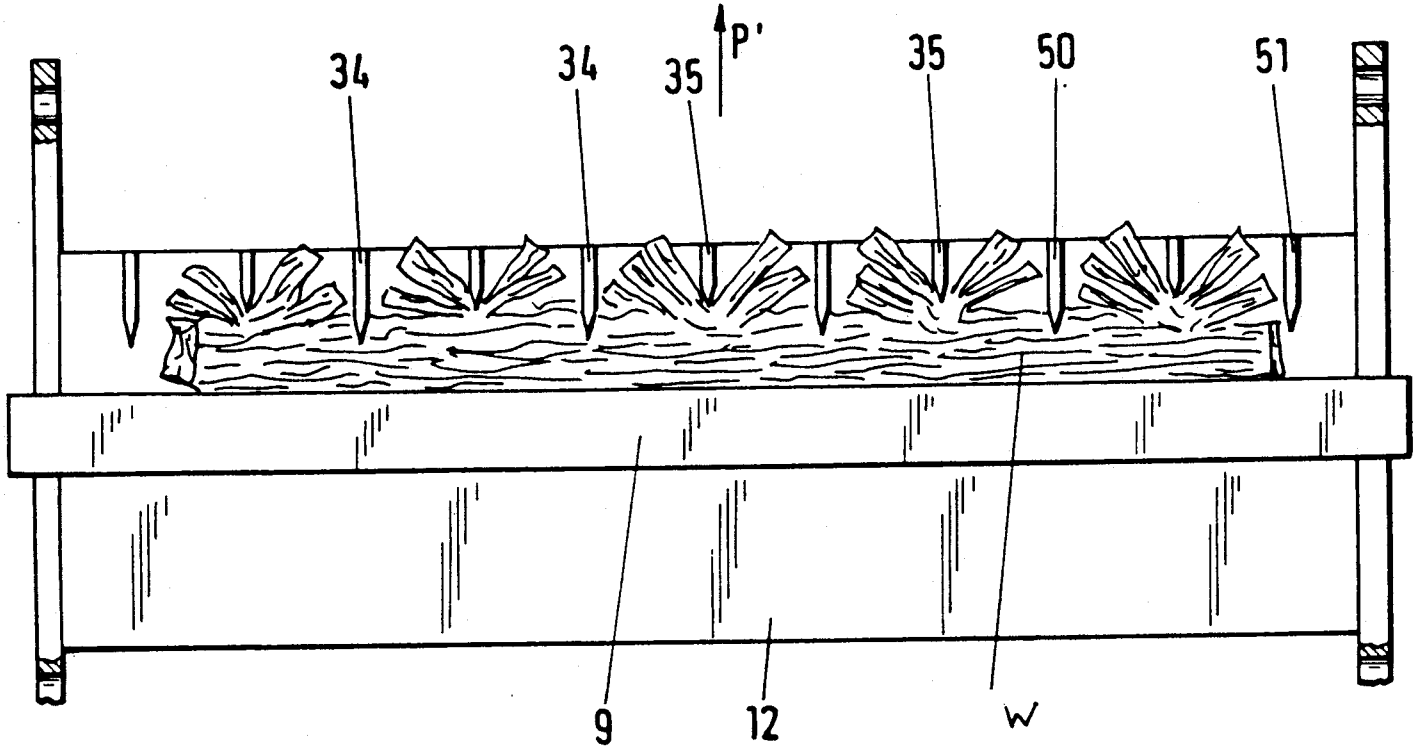
FIG. 11 shows the manner of operation of the splitting blades of FIG. 7 during the cutting process in cooperation with the lower blade.

During the shearing process, the material (FIGS. 11 and 12) is greatly compressed, with the compressive strength progressively increasing into the last phase of the cutting process. By using the elbow joint system 10 for the raising and lowering movement, there results in the final phase of the extension of the elbow joint a nearly infinite increase in pressure. Thus, the cutting pressure that increases during the cutting process is opposed by an increase in pressure in the final phase of the elbow joint extension. As a result. with the least possible use of force for the extension of the elbow joint, the counteracting increase in pressure during the shearing process can be overcome in a nearly ideal manner.

Figure 7:
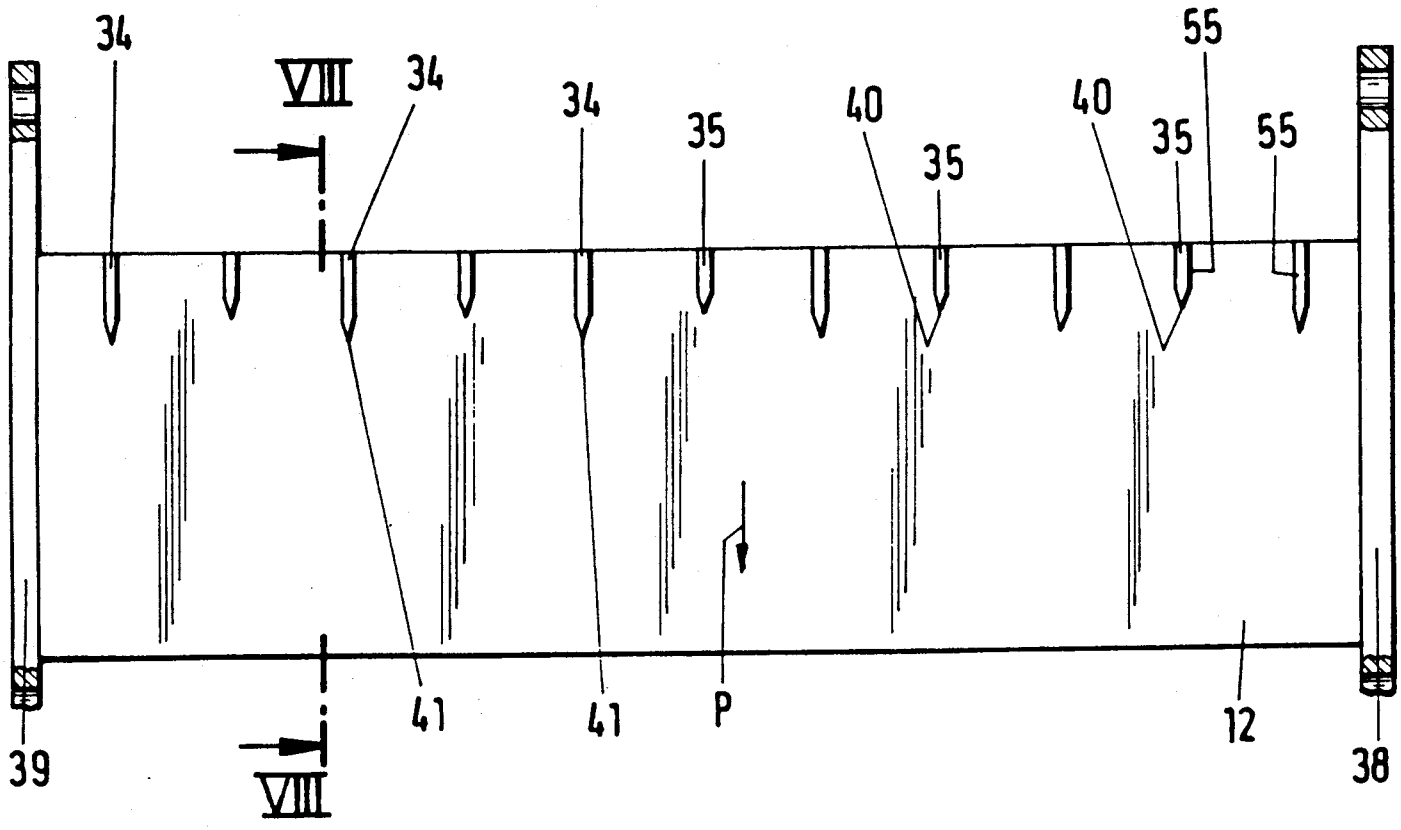
FIG. 7 shows how splitting blades are disposed along an abutment means of the machine of FIG. 1.

A plurality of transverse splitting blades 34, 35 are advantageously secured to the abutment means 12 in front of the shearing blade 11. These blades 34, 35 are key-seated in the abutment means 12 and are secured in this position by clamping blocks 36 that are disposed thereabove (see FIG. 1). For this purpose, the upper side of the abutment means 12 is provided with slots 55 (FIG. 7) into which the blades 34, 35 are placed and from which these blades project in the direction toward the hopper 5. The clamping blocks 36 are screwed or bolted onto the upper side of the abutment means 12. The blades 34, 35 have essentially the same construction. However, as can be seen from FIG. 7, the splitting blades 34 are somewhat higher than are the splitting blades 35. The splitting blades 34 are spaced from the narrow sides 38, 39 of the abutment means 12, and are spaced from one another by a distance that is several times greater than this spacing. The splitting blades 35 are disposed in the gaps between adjacent splitting blades 34, whereby the splitting blades 35 are equidistantly spaced from one another and from the adjacent blades 34. When viewed in the direction of cutting (the arrow P), the cutting edges 40 of the splitting blades 35 are recessed relative to the cutting edges 41 of the splitting blades 34.

Figure 8:
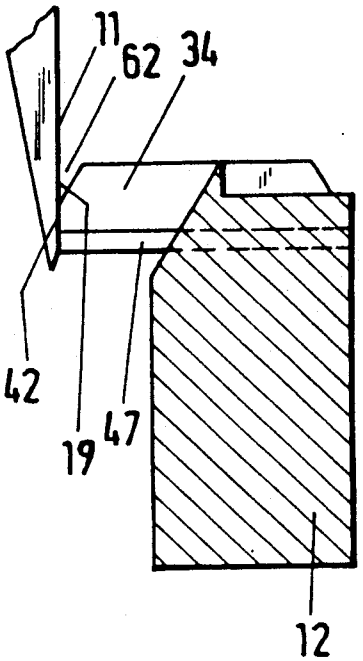
FIG. 8 is a cross-sectional view taken along the line VIII—VIII in FIG. 7, and also shows a portion of the upper blades.
Figure 9:
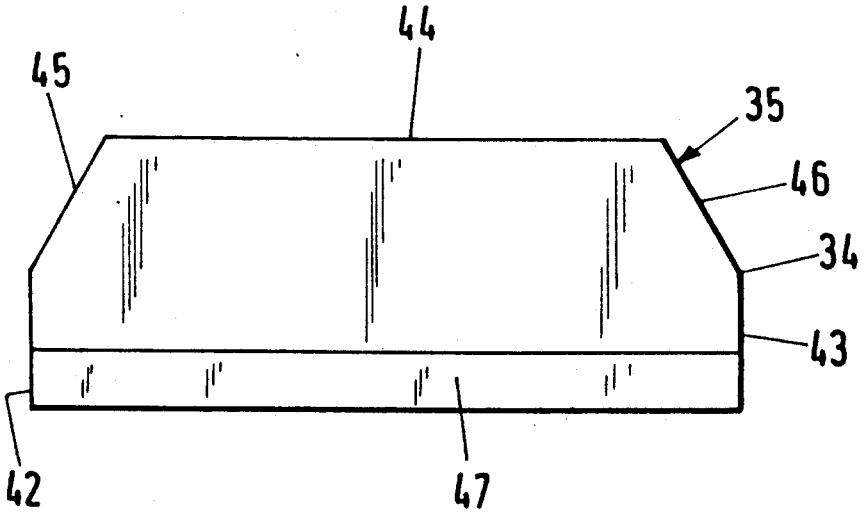
FIG. 9 is an enlarged view of one of the splitting blades of FIG. 7.
Figure 10:
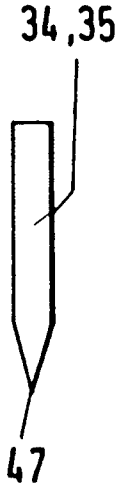
FIG. 10 is a side view of the splitting blade of FIG. 9.
Figure 12:
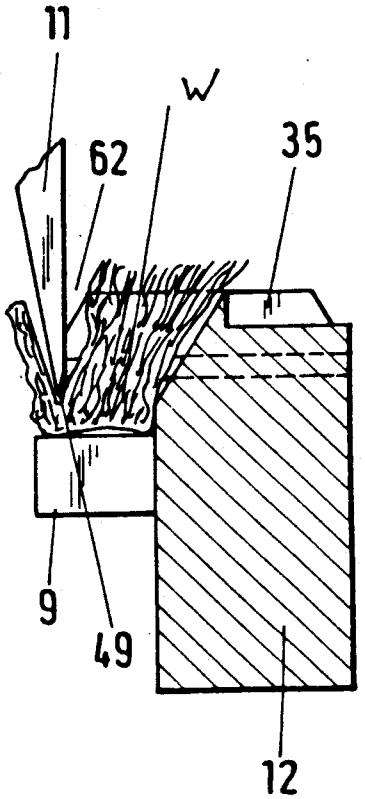
FIG. 12 is a view similar to that of FIG. 8, but during the cutting process and in cooperation with the lower blade.

As can be seen from FIGS. 9 and 10, the splitting blades 34, 35 are embodied as elongated rectangular blades, the narrow edges of which, on both sides, are chamfered over a portion of their height, so that inclined edge portions 45, 46 are formed that extend toward one another and join a long edge 44. The inclined edge portions 45, 46 merge into edge portions 42, 43 that extend parallel to one another and perpendicular to the cutting edge 40, 41. As shown in FIGS. 1, 8, and 12, in the installed position one of the edge portions 42, 43 of the splitting blades 34, 35 rests against the shearing blade 11. The edge portions 42, 43 advantageously extend over approximately one third to one half of the height of the splitting blades 34, 35. However, it would also be possible to have the entire height of the splitting blades rest against the shearing blade 11. However, in such a situation more time would be necessary for wood that has entered between the shearing blade 11 and the splitting blades 34, 35 to be conveyed upwardly in the direction of the arrow P' (see FIG. 11).

As can be seen from FIG. 10, the key-seating of the splitting blades 34, 35 in the abutment means 12 is achieved in that an edge region 47 that is disposed opposite the long edge 44 is tapered in the manner of a cutting edge.

Due to the fact that the cutting blades 34, 35 rest against the shearing blade 11 only in the region of their edge portions 42, 43, i.e. over only approximately one third of the height of the blade, material that during the cutting process enters between the shearing blade 11 and the splitting blades 34, 35 then again leaves the blades when it has overcome the surfaces 42, 19 of the splitting blade 34 and the shearing blade 11 that rest against one another (see FIG. 8). The material W, especially wood and wood-like materials, but also plastic pieces, such as profile scraps in the plastic industry, which material is present in the hopper 5 and has come to rest against the abutment means 12 as a result of the inclined position of the hopper during the downward stroke, is severed or broken up by a cut that extends transverse to the longitudinal axis of the hopper by means of the blades 9 and 11, which are disposed transverse to the hopper 5. In so doing, depending upon the shape of the wood that is to be cut and the position thereof in the hopper, the fibers of the wood are disposed in the direction of, transverse to, or at an angle to the blades. Thus, as a result of the shearing cut strips result that in the longitudinal direction correspond to the cutoff length established by the distance of the abutment means 12 from the shearing blade 11, and in the transverse direction correspond to the size of the piece that is to be reduced in size.

For conveying and combustion reasons, such oblong, compact pieces of material that have been reduced in size (see FIG. 1) are not always suitable for subsequent combustion of this material in combustion or firing equipment that is provided with pneumatic, worm gear, or other conveying means, nor is such material always suitable for other further use. For this reason, the transverse splitting blades 34, 35 are disposed after the shearing blade 11 as viewed in the direction of feed; these splitting blades split or cut the pieces of wood that are disposed transverse to the direction of feed.

This splitting is effected as follows. During the upward movement of the hopper 5, the material that rests upon the counterblade 9 is pressed through the gap 49 (FIG. 12) that is formed between the abutment means 12 and the cutting edge of the shearing blade 11. The material is then cut into uniform pieces (FIG. 11) by the splitting blades 34, 35 that are disposed slightly higher than the cutting edge of the shearing blade 11. An extremely high pressure is required to cut through the oblong pieces of material, especially if the fibers thereof extend in a direction transverse to the hopper 5. This is particularly true if an entire system of splitting blades is disposed along the shearing blade 11. The pressure that is required to have the splitting blades accomplish a through cut is, as previously mentioned, achieved by the extension of the elbow lever system, i.e. the raising and lowering mechanism 10.

By arranging the adjacent splitting blades 34, 35 in such a way that they are offset in the direction of height, the forces that occur during the transverse cutting of the material are reduced. As previously mentioned, the splitting blades 34 and 35, when viewed transverse to the hopper, are not aligned with one another; rather, the splitting blades are respectively alternately offset relative to one another in the direction of height. As a result, in the first phase of the cutting-through process, the material displacement that respectively occurs between the blades due to the wedge shape thereof (see FIGS. 11, 12) is reduced to approximately one half. In the second phase of the cutting-through process, i.e. when in addition to the splitting blades 34 the splitting blades 35 also engage the material, the outer sides of the portions of the material that are present between adjacent splitting blades 34 already rest against those outer sides 50. 51 of the splitting blades 34 that extend parallel to the direction of discharge (arrow P'), while the splitting of the piece of material into two halves is still effected by the shorter splitting blades 35 that are disposed between the splitting blades 34. Due to the resistance of the wedge-shaped edge portions 47 of the shorter splitting blades 35, the material portions that are pushed outwardly in the direction of the arrow P' are retained at the splitting blades 35, whereas those ends of the material portions that are disposed in the region of the other splitting blades 34 can migrate outwardly in the direction of the arrow P' without significant resistance. Consequently, a diagonally directed force results that on the one hand causes a splitting of the compact wood and on the other hand, due to the diagonal position, provides a release of the clamping effect between the blades 34, 35 that results from the wedge-shaped edge portions 47 of the splitting blades 35.

By using the splitting blades, in conjunction with the shearing blade 11 and due to the pressure transfer achieved by the counterblade 9 via the elbow lever system 10, a reduction in size of the wood or wood-like material into the chip shape and size required for production is achieved. This reduction in size is further enhanced by arranging the splitting blades 34 and 35 in such a way that they ar offset in height.

Since only approximately one third of the height of the splitting blades 34, 35 rests against the shearing blade 11, the pieces of wood that enter between the shearing blade and the splitting blades can be rapidly conveyed upwardly. In this connection, the wedge space 62 (see FIGS. 8 and 12) that results above the contact surfaces due to the inclined edge portions 45, 46 of the splitting blades 34, 35 further contributes to the removal of the wood pieces because the wood can immediately spread or expend in this space.

The present invention is, of course, in no way restricted to the specific disclosure of the specification and drawings, but also encompasses any modifications within the scope of the appended claims.

What is claimed is:

1. In a machine for reducing the size of material, including a container for the material, and including at least one fixed and at least one movable blade, the improvement wherein:

a frame structure is provided on which said fixed blade is disposed;

said container is in the form of a hopper that is movably mounted on said frame structure and has a base on which is disposed said movable blade; and a raising and lowering mechanism is mounted on said frame structure for moving said container and hence said movable blade in such a way that said movable blade is at least nearly parallel to said fixed blade.

2. A machine according to claim 1, in which said raising and lowering mechanism is an elbow joint arrangement.

3. A machine according to claim 1, in which said container is movable in a vertical direction.

4. A machine according to claim 3, in which said container is disposed at an incline in said machine and has an upper end that is pivotably mounted on said frame structure about a transverse axis.

5. A machine according to claim 4, in which said container has a lower discharge portion, in the vicinity of which said movable blade is transversely disposed.

6. A machine according to claim 4, in which said fixed blade is a shearing blade.

7. A machine according to claim 4, in which said movable blade is movable against said fixed blade, in the manner of a shearing pincers, via an upward movement of said container.

8. A machine according to claim 7, in which in a starting position prior to a cutting process, said container is inclined downwardly.

9. A machine according to claim 8, in which said container is inclined at an angle of approximately 40° to the horizontal.

10. A machine according to claim 4, which includes an abutment means that is disposed in front of a lower discharge portion of said container to delimit the feed of material therein.

11. A machine according to claim 10, in which said abutment means is centrally disposed relative to said container and extends perpendicular to said base thereof.

12. A machine according to claim 10, in which said abutment means is in the form of an end plate.

13. A machine according to claim 10, in which said raising and lowering mechanism engages said base of said container.

14. A machine according to claim 13, in which said raising and lowering mechanism includes a lower elbow lever in the form of a swivel arm.

15. A machine according to claim 14, in which said swivel arm is mounted at two locations to a base plate of said frame structure.

16. A machine according to claim 14, in which said raising and lowering mechanism further includes an upper elbow lever having a lower end that carries elbow joint pivot means supported on said lower elbow lever.

17. A machine according to claim 16, in which said upper elbow lever has an upper end that is mounted on a transversely extending shaft that in turn is mounted below said base of said container.

18. A machine according to claim 17, in which said upper elbow lever has a box-type construction.

19. A machine according to claim 10, in which said movable blade is disposed on a support that extends parallel to said base of said container.

20. A machine according to claim 10, in which a plurality of spaced-apart splitting blades that are arranged next to one another are disposed in front of said fixed blade.

21. A machine according to claim 20, in which said splitting blades are key-seated in said abutment means and are secured therein via clamping means.

22. A machine according to claim 21, in which said splitting blades have an oblong configuration and project transversely outwardly beyond said abutment means.

23. A machine according to claim 22, in which each of said splitting blades is provided with inclined edge portions that extend at an angle toward one another.

24. A machine according to claim 23, in which said inclined edge portions extend at an angle of approximately 60° relative to one another.

25. A machine according to claim 23, in which said splitting blades rest against said fixed blade.

26. A machine according to claim 25, in which approximately one third of the height of said splitting blades rests against said fixed blade.

27. A machine according to claim 23, in which each of said splitting blades has a longitudinal edge that is remote from the inclined edge portions and is tapered in the manner of a wedge or cutting edge.

28. A machine according to claim 27, which includes splitting blades disposed at two different levels.

29. A machine according to claim 28, in which lower and higher splitting blades are alternately disposed.

30. A machine according to claim 28, in which higher ones of said splitting blades project downwardly, in a direction toward said movable blade, beyond lower ones of said splitting blades by a distance that is approximately equal to the height of said wedge-shaped longitudinal edge.

* * * * *